US010118752B2

(12) United States Patent
Itabashi

(10) Patent No.: US 10,118,752 B2
(45) Date of Patent: Nov. 6, 2018

(54) PACKING MEMBER AND CUSHION

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 116 days.

(21) Appl. No.: 15/003,316

(22) Filed: Jan. 21, 2016

(65) Prior Publication Data

US 2016/0207687 A1 Jul. 21, 2016

(51) Int. Cl.

*B65D 81/03* (2006.01)
*B65D 81/05* (2006.01)
*G03G 21/18* (2006.01)

(52) U.S. Cl.

CPC ..... *B65D 81/052* (2013.01); *B65D 81/055* (2013.01); *G03G 21/181* (2013.01); *G03G 2221/1807* (2013.01)

(58) Field of Classification Search

CPC .. B65D 81/052; B65D 81/051; B65D 81/055; B65D 81/057; B65D 81/058; B65D 81/03; B65D 81/022; B65D 81/025; G03G 2221/1807; G03G 21/181

USPC ..... 206/522

See application file for complete search history.

(56) References Cited

U.S. PATENT DOCUMENTS

2003/0062286 A1* 4/2003 Igarashi ..... B65D 81/052 206/522
2004/0232031 A1 11/2004 Nishi et al.

FOREIGN PATENT DOCUMENTS

CN 101152915 A 4/2008
CN 201343241 Y 11/2009
CN 102107750 A 6/2011
CN 103241455 A 8/2013
FR 2680764 A1 * 3/1993 ..... B65D 81/02
JP H11-189219 A 7/1999
JP 2004284609 A 10/2004
JP 2004-338785 A 12/2004

OTHER PUBLICATIONS

Jul. 30, 2018—(CN) Notification of the First Office Action—App 201610039197.9.

* cited by examiner

*Primary Examiner* — J. Gregory Pickett
*Assistant Examiner* — Allan Stevens
(74) *Attorney, Agent, or Firm* — Banner & Witcoff, Ltd.

(57) ABSTRACT

A packing member includes: a cushion surrounding an object and containing gas; an elastic member attachable and detachable from the cushion; and a container box containing the cushion to which the elastic member is attached. The container box includes: a container having an opening; and a lid that opens and closes the opening. The cushion includes: a first portion surrounding a portion of the object and containing the gas; a no-gas containing portion containing no gas; and a pair of second portions containing the gas, communicating with the first portion, and respectively provided on opposite sides of the object. The elastic member includes: a base disposed between the lid and the no-gas containing portion; and a pair of nipping portions respectively extending from opposite ends of the base and each disposed between the container and a corresponding one of the pair of second portions.

11 Claims, 5 Drawing Sheets

PACKING MEMBER AND CUSHION

CROSS REFERENCE TO RELATED APPLICATION

The present application claims priority from Japanese Patent Application No. 2015-009244, which was filed on Jan. 21, 2015, the disclosure of which is herein incorporated by reference in its entirety.

BACKGROUND

Technical Field

The following disclosure relates to a packing member including a cushion for protecting an object and to the cushion.

Description of the Related Art

There are known packing members for packing a process cartridge mountable on and removable from a device body of an electronic-photographic image forming apparatus. One example of the packing members is a packing member including: a cushion including a plurality of gas containing portions arranged so as to surround the process cartridge and each containing air; and a box for containing this cushion. In this technique, the gas containing portions may be broken due to external shock if air is filled with each of the gas containing portions so as to stretch its surface in order for the cushion to well protect the process cartridge. In contrast, reduction in amount of air in each of the gas containing portions can prevent the breakage of the gas containing portions but leads to a deteriorated shock absorbing function of the cushion.

A technique for solving this problem is known. In this technique, a smaller amount of air is stored in advance in a bag for containing an object. After the object is placed in the bag, opposite end portions of the bag are firmly fastened respectively with clips, thereby increasing an internal pressure of the bag so as to stretch its surface.

SUMMARY

In this technique, however, since the opposite end portions of the bag containing air are fastened with the respective clips, when a shock is applied to the bag, the air in the bag acts on its fastened portions so as to expand them in all directions, leading to detachment of the clips from the bag.

Accordingly, an aspect of the disclosure relates to a packing member and a cushion capable of preventing an elastic member from being detached from the cushion due to deformation of the cushion when a shock is applied to the cushion to which the elastic member is attached.

In one aspect of the disclosure, a packing member includes: a cushion surrounding an object and containing gas that absorbs shock to the object; an elastic member attachable to and detachable from the cushion; and a container box containing the cushion to which the elastic member is attached. The container box includes: a container formed with an opening; and a lid that opens and closes the opening. The cushion includes: a first portion surrounding a portion of the object and containing the gas; a no-gas containing portion not containing the gas; and a pair of second portions respectively provided on opposite sides of the object and communicating with the first portion, the pair of second portions containing the gas. The elastic member includes: a base disposed between the lid and the no-gas containing portion; and a pair of nipping portions respectively extending from opposite ends of the base and each disposed between the container and a corresponding one of the pair of second portions.

In another aspect of the disclosure, a packing member includes: a cushion surrounding an object and containing gas that absorbs shock to the object; and an elastic member attachable to and detachable from the cushion. The cushion includes: a first portion surrounding a portion of the object and containing the gas; a no-gas containing portion not containing the gas; and a pair of second portions respectively provided on opposite sides of the object and communicating with the first portion, the pair of second portions containing the gas. The elastic member includes: a base opposed to the no-gas containing portion; and a pair of nipping portions respectively extending from opposite ends of the base and contactable with the pair of second portions.

In another aspect of the disclosure, a cushion includes: a plurality of first air bags containing air; a plurality of second air bags containing air and located apart from the plurality of first air bags; a sheet portion having a substantially cylindrical shape, the sheet portion being located between the plurality of first air bags and the plurality of second air bags in a first direction; and a pair of pressed portions disposed on the sheet portion and containing air, the sheet portion being located between the pair of the pressed portions in a second direction perpendicular to the first direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
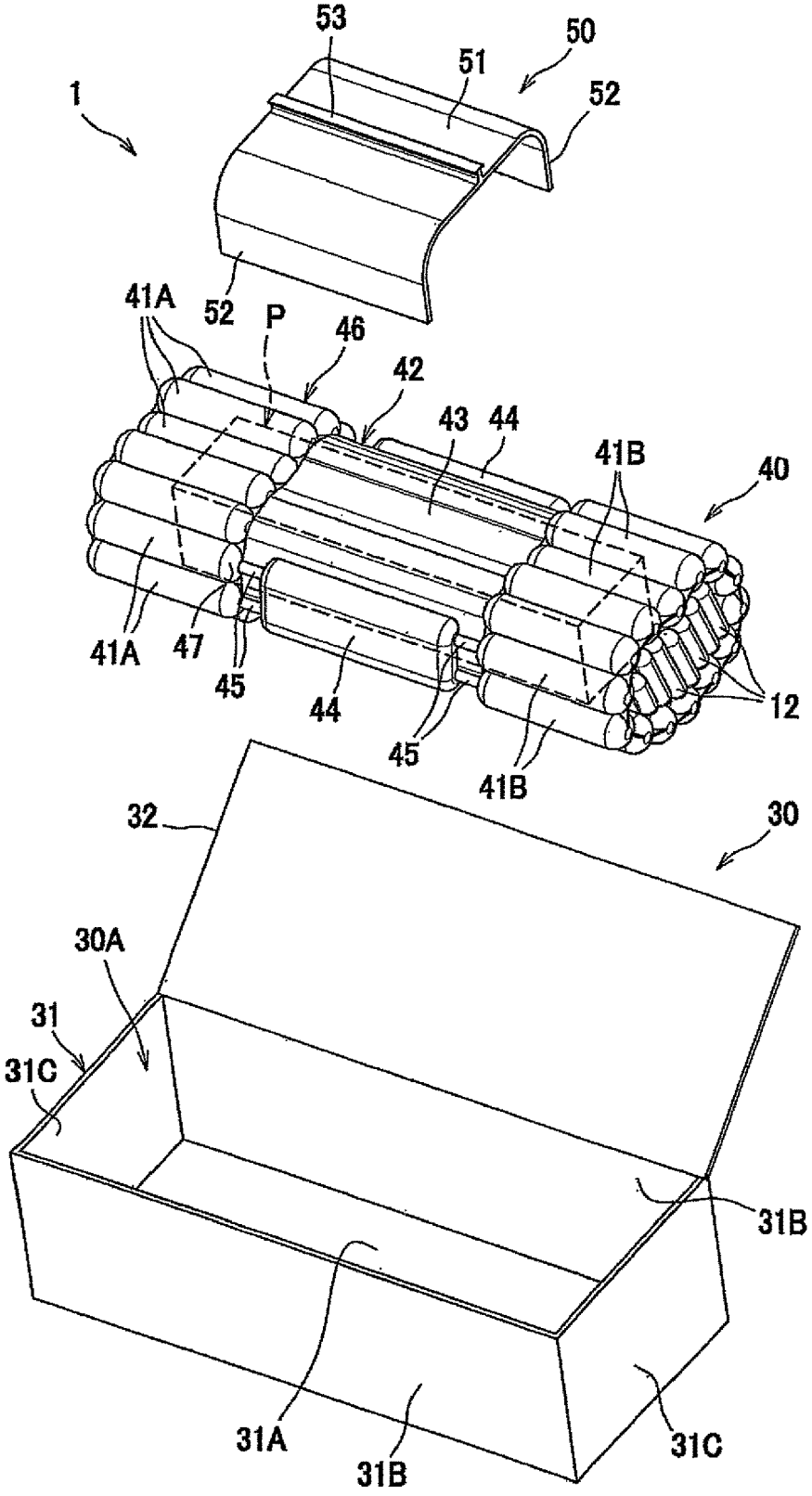
FIG. 1 is a perspective view of a packing member according to one embodiment.

Hereinafter, there will be described one embodiment by reference to the drawings. As illustrated in FIG. 1, a packing member 1 includes a cushion 40, a resin elastic member 50, and a container box 30.

The cushion 40 is for protecting a process cartridge P as one example of an object and a developing cartridge. The cushion 40 has a substantially hollow circular cylindrical shape for accommodating the process cartridge P therein. The cushion 40 extends in the lengthwise direction of the process cartridge P (hereinafter may be simply referred to as "the lengthwise direction").

Figure 4A:
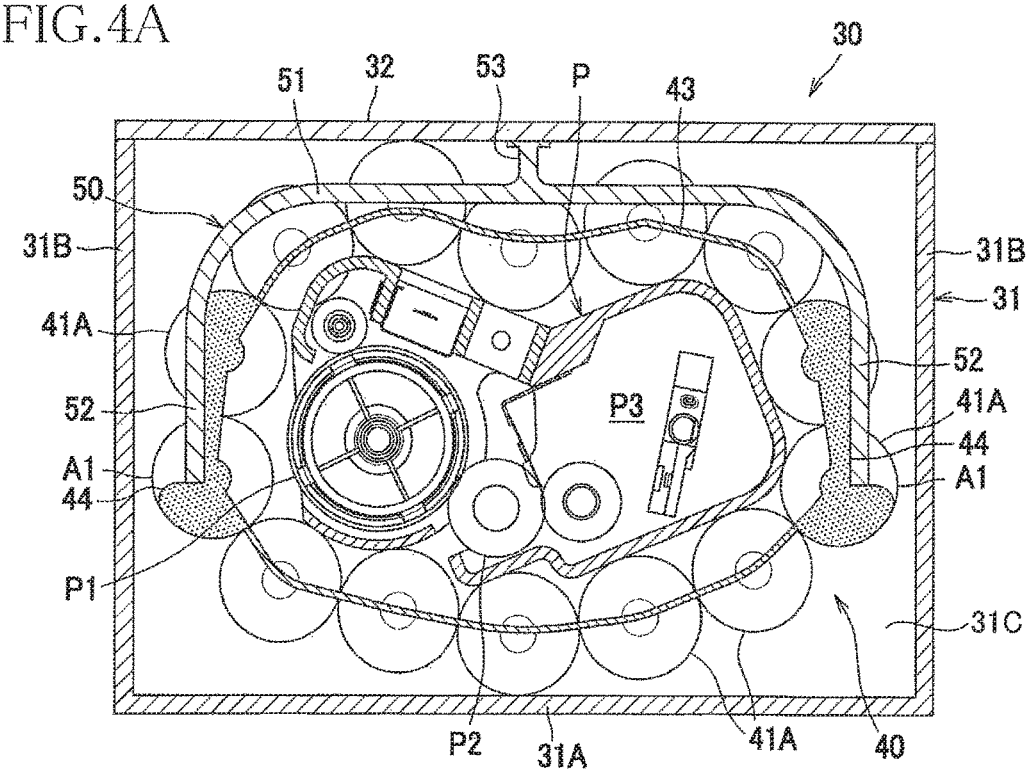
FIGS. 4A and 4B are cross-sectional views each illustrating operations and effects of the elastic member.
Figure 4B:
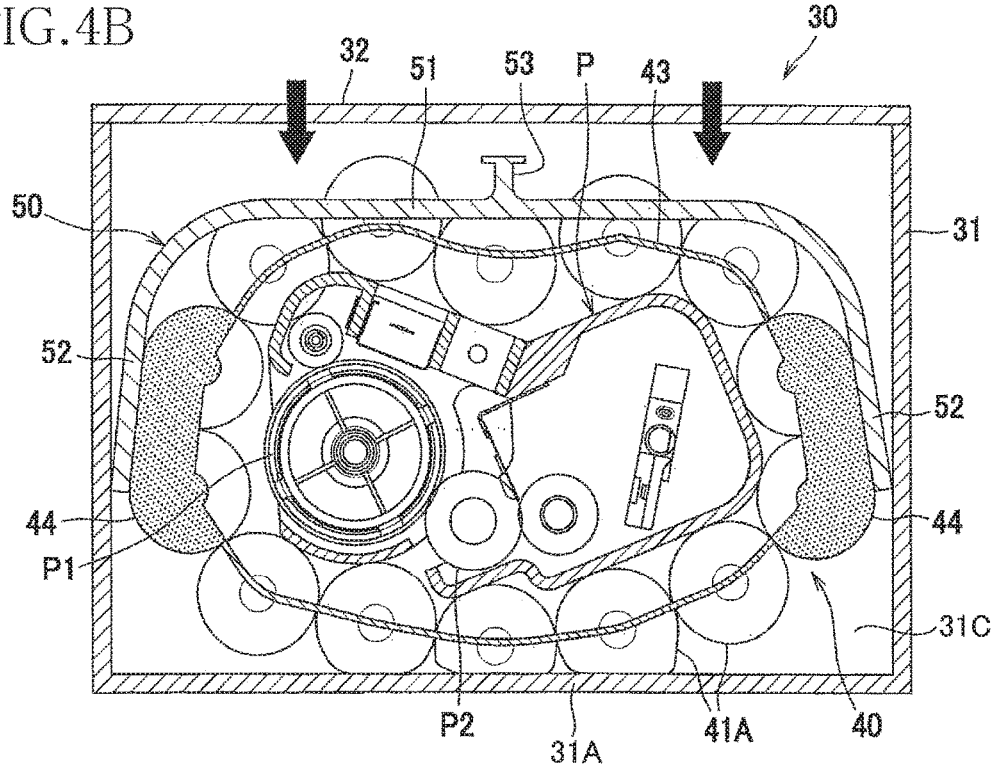
Figure 5:
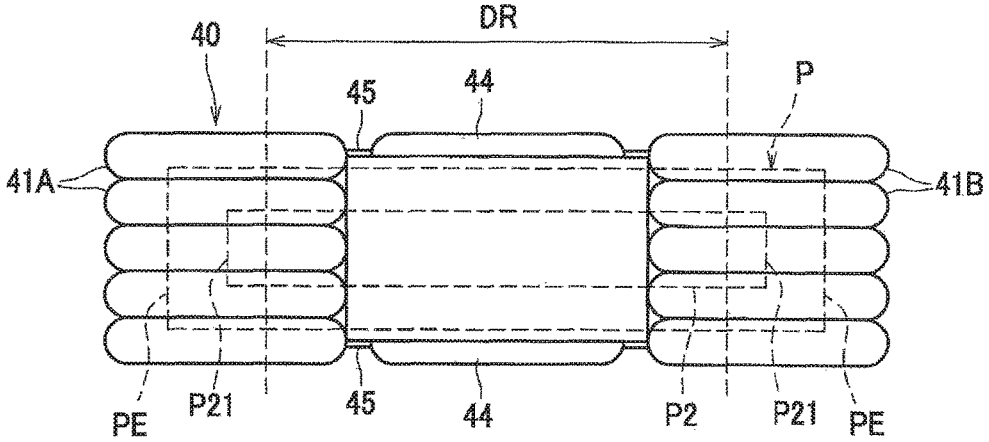
FIG. 5 is a side view illustrating a relationship between the cushion and components including a process cartridge.

It is noted that illustration of the process cartridge P is simplified in FIGS. 1 and 5 for easy understanding. The process cartridge P is used for image forming apparatuses such as printers and multi-function peripherals. The process cartridge P has an elongated shape and as illustrated in FIG. 4 includes: a photoconductive drum P1 on which an electrostatic latent image is to be formed; a developing roller P2 configured to supply toner to the electrostatic latent image formed on the photoconductive drum P1; and a toner containing chamber P3 for storing toner.

Returning to FIG. 1, the cushion 40 includes a cylindrical portion 46, and a plurality of end-side air bags 12 for filling openings respectively formed in opposite end portions of the cylindrical portion 46. It is noted that FIG. 1 illustrates only the end-side air bags 12 provided at one end of the cushion 40. Air bags 41A, 41B, pressed portions 44, and connectors 45 of the cylindrical portion 46 which will be described below and the plurality of end-side air bags 12 contain air, as one example of gas, for absorbing shock to the process cartridge P.

The cylindrical portion 46 includes: the plurality of first air bags 41A and the plurality of second air bags 41B each as one example of a first portion; and a coupler 42 which couples the plurality of first air bags 41A and the plurality of second air bags 41B to each other.

Each of the first air bags 41A has a hollow circular cylindrical shape elongated in the lengthwise direction. The first air bags 41A surround a portion of the process cartridge P on a plane perpendicular to the lengthwise direction. Specifically, the first air bags 41A surround one end portion of the process cartridge P in the lengthwise direction. The first air bags 41A are joined to each other. Each of the first air bags 41A has communication holes, not illustrated, for communication with the other first air bags 41A.

Each of the second air bags 41B has a hollow circular cylindrical shape elongated in the lengthwise direction. The second air bags 41B surround a portion of the process cartridge P on the plane perpendicular to the lengthwise direction. Specifically, the second air bags 41B surround the other end portion of the process cartridge P in the lengthwise direction. The second air bags 41B are joined to each other. Each of the second air bags 41B has communication holes, not illustrated, for communication with the other second air bags 41B.

The coupler 42 includes: a sheet-like portion 43, as one example of a no-gas containing portion, containing no air; the pressed portions 44 each having a hollow rectangular parallelepiped shape extending from the sheet-like portion 43 and protruding outward; the connectors 45 each provided for communication between a corresponding one of the pressed portions 44 and a corresponding one of the first air bags 41A and the second air bags 41B. The sheet-like portion 43 has a substantially cylindrical shape and couples central portions of the respective air bags 41A, 41B to each other.

The pressed portions 44, each as one example of a second portion, are respectively provided on opposite sides of the process cartridge P in a widthwise direction of the process cartridge P (hereinafter may be simply referred to as "widthwise direction"). Each of the pressed portions 44 has a rectangular parallelepiped shape extending in the lengthwise direction of the process cartridge P. Each of the pressed portions 44 communicates with a corresponding one of the first air bags 41A via a corresponding one of the connectors 45 and communicates with a corresponding one of the second air bags 41B via a corresponding one of the connectors 45.

Each of the connectors 45 connects between a corresponding one of the pressed portions 44 and a corresponding one of the air bags 41A, 41B. Each connector 45 has a cylindrical shape, and its diameter is less than that of each of the air bags 41A, 41B. Two connectors 45 are provided on each of opposite ends of each pressed portion 44 in the lengthwise direction. Each of the connectors 45 is disposed on an inner side of a corresponding one of the air bags 41A, 41B in the widthwise direction. In other words, each of the connectors 45 is spaced apart from an inner surface of a container 31 which will be described below. With this construction, a step 47 is formed between each connector 45 and the corresponding air bags.

The cross-sectional area of each connector 45 in the widthwise direction is greater than or equal to one eighth of that of each of the air bags 41A, 41B in the widthwise direction and less than or equal to one fourth of that of each of the air bags 41A, 41B in the widthwise direction. The cross-sectional area of each connector 45 in the widthwise direction is preferably equal to one eighth of that of each of the air bags 41A, 41B in the widthwise direction. The cross-sectional area of each connector 45 in the widthwise direction ranges between 250 $mm^2$ and 750 $mm^2$, for example. The cross-sectional area of each of the air bags 41A, 41B ranges between 2000 $mm^2$ and 3000 $mm^2$, for example.

The step 47 serves as a restrainer which limits movement of the elastic member 50, which will be described below, in the lengthwise direction along a surface of the coupler 42. This restrainer prevents the elastic member 50 from being moved along a surface of the cushion 40 and detached from the cushion 40 in the event of a drop of the cushion 40, for example.

The air bags 41A, 41B, the pressed portions 44, and the connectors 45 communicate with each other, enabling air to flow through these components. Each of the air bags 41A, 41B, the pressed portions 44, and the connectors 45 contains a corresponding amount of air which is not enough to stretch a surface of the component.

In other words, a total amount of air contained in the air bags 41A, 41B, the pressed portions 44, and the connectors 45 is less than a total amount of capacities of the air bags 41A, 41B, the pressed portions 44, and the connectors 45. For easy understanding, FIGS. 1-6 illustrate each of the air bags 41A, 41B, the pressed portions 44, and the connectors 45 in a surface-stretched state although the amount of air contained in each of the air bags 41A, 41B, the pressed portions 44, and the connectors 45 is not enough to establish the surface-stretched state.

Each of the plurality of end-side air bags 12 has a hollow circular cylindrical shape having a length appropriate for filling each opening formed in the cylindrical portion 46. The end-side air bags 12 and the second air bags 41B at the one end of the cushion 40 are joined together. The end-side air bags 12 and the first air bags 41A at the other end of the cushion 40 are joined together. Each of the end-side air bags 12 is filled with air so as to stretch a surface thereof.

As illustrated in FIG. 5, each of the air bags 41A, 41B has a portion which is to overlap a development region DR of the developing roller P2 when viewed in a radial direction of the developing roller P2 (i.e., the widthwise direction of the process cartridge P). The development region DR is a region at which toner is supplied to the electrostatic latent image formed on the photoconductive drum P1. At this development region DR, the length of the developing roller P2 in its axial direction is equal to a region of the photoconductive drum P1 on which the electrostatic latent image is formed.

When viewed in the radial direction of the developing roller P2, each of the air bags 41A, 41B has (i) a portion which overlaps a corresponding one of opposite end portions P21 of the developing roller P2 and (ii) a portion which overlaps a corresponding one of opposite end portions PE of the process cartridge P.

As illustrated in FIG. 1, the elastic member 50 is attachable to and detachable from the cushion 40 in a particular direction as one example of a first direction. The elastic member 50 includes: a base 51; a pair of nipping portions 52 extending in the particular direction respectively from opposite ends of the base 51 in the widthwise direction to nip the cushion 40 therebetween; and a protrusion 53 extending, in a direction (as one example of a second direction) opposite to the particular direction, from a central portion of the base 51 in the widthwise direction. In other words, in a state in which the elastic member 50 is attached to the cushion 40 and in a state in which the cushion 40 is placed in the container box 30 which will be described below, the pair of nipping portions 52 extend from the respective opposite ends of the base 51 in the widthwise direction toward a bottom 31A of a container 31 of the container box 30 which will be described below to nip the cushion 40, and the protrusion 53 protrudes from the central portion of the base 51 in the widthwise direction toward a lid 32 of the container box 30 which will be described below.

As illustrated in FIG. 4A, the base 51 is disposed so as to be opposed to the sheet-like portion 43 of the cushion 40, which contains no air, in the state in which the elastic member 50 is attached to the cushion 40. In other words, the base 51 is disposed between the sheet-like portion 43 and the lid 32 of the container box 30 which will be described below. It is noted that the sheet-like portion 43 is opposed to and spaced apart from the bottom 31A of the container 31 of the container box 30 which will be described below.

The pair of nipping portions 52 can be bent in a direction in which the nipping portions 52 are opposed to each other. In a state in which the cushion 40 to which the elastic member 50 is attached is contained in the container 31 of the container box 30, each of the nipping portions 52 is disposed between a corresponding one of the pressed portions 44 and a corresponding one of first side walls 31B of the container 31 of the container box 30. Specifically, each of the nipping portions 52 is located nearer to the process cartridge P than a corresponding one of outermost portions Al of the respective air bags 41A, 41B (noted that FIGS. 4A and 4B illustrate only the air bags 41A) in the widthwise direction, i.e., in a direction in which the process cartridge P is nipped between the nipping portions 52. As a result, the pair of nipping portions 52 are spaced apart from the inner surface of the container 31. In other words, as illustrated in FIG. 4A, in the state in which the cushion 40 to which the elastic member 50 is attached is contained in the container 31 of the container box 30, the pair of pressed portions 44 are nipped and held between the pair of nipping portions 52 of the elastic member 50 such that the distance between each of the pair of pressed portions 44 and an inner wall of the container 31 is greater than the distance between each of the air bags 41A, 41B and the inner wall of the container 31.

The protrusion 53 has a substantially T-shape in cross section. That is, a distal end portion of the protrusion 53 protrudes in the widthwise direction toward opposite sides of a basal end portion of the protrusion 53. This construction allows a user to hold the distal end portion of the protrusion 53 with his or her fingers to easily detach the elastic member 50 from the cushion 40.

It is noted that the method described in Japanese Patent Application Publication No. 2004-338785 may be employed for a material of the cushion 40 and a method of manufacturing the cushion 40. For example, the cushion 40 may be formed by thermal welding for two flexible plastic films superposed on each other. It is noted that examples of the plastic film include a film in which a nylon layer is sandwiched between a polyethylene layer and a polypropylene layer.

Specifically, the two plastic films are superposed on each other, and then thermal welding is carried out for boundaries between the air bags 41A, 41B, so that the air bags 41A, 41B are formed. Thereafter, the two plastic films are bent cylindrically, and thermal welding is carried out for the ends of the respective air bags 41A, 41B, so that the cylindrical portion 46 of the cushion 40 is formed. It is noted that the end-side air bags 12 serving as opposite end surfaces of the cushion 40 can be formed in the same manner.

It is noted that air is forced into each of the air bags 41A, 41B through an air intake opening which may be formed in one end portion of each air bag 41A, for example. It is noted that a well-known check valve, as described in Japanese Patent Application Publication No. 2004-338785, may be provided near each of the air intake openings.

As illustrated in FIG. 1, the container box 30 has a hollow rectangular parallelepiped shape and accommodates the cushion 40 to which the elastic member 50 is attached. The container box 30 is formed of paper. The container box 30 includes: the container 31 having an opening 30A; and the lid 32 for opening and closing the opening 30A.

The container 31 has (a) the bottom 31A having a rectangular shape elongated in the lengthwise direction, (b) the pair of first side wall 31B respectively extending upward from end portions of the bottom 31A which correspond to the long sides of the rectangular shape, and (c) a pair of second side walls 31C extending upward from end portions of the bottom 31A which correspond to the short sides of the rectangular shape. The lid 32 is formed integrally with an upper end of one of the first side walls 31B so as to be pivotable about the upper end.

There will be next explained a method of packing the process cartridge P in the packing member 1. Initially, the process cartridge P is placed into the cylindrical portion 46 of the cushion 40 containing no air. Then, air is supplied to the air bags 41A, 41B, the pressed portions 44, and the connectors 45 constituting the cylindrical portion 46. An amount of air in this supply is less than the total capacity of the air bags 41A, 41B, the pressed portions 44, and the connectors 45. The plurality of end-side air bags 12 filled with air are then fitted into the opposite ends of the cylindrical portion 46, and thermal welding is carried out.

Figure 2:
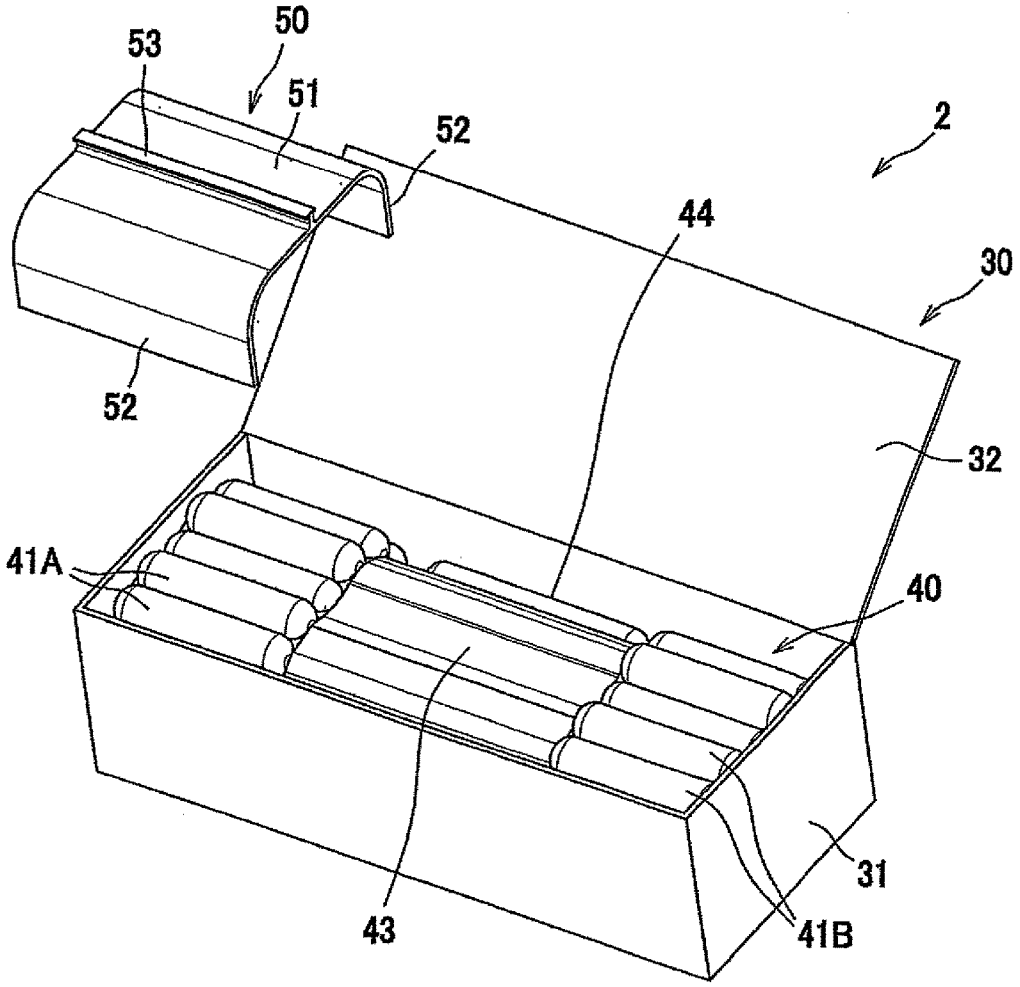
FIG. 2 is a perspective view illustrating a state in which a cushion is placed in a container box.
Figure 3:
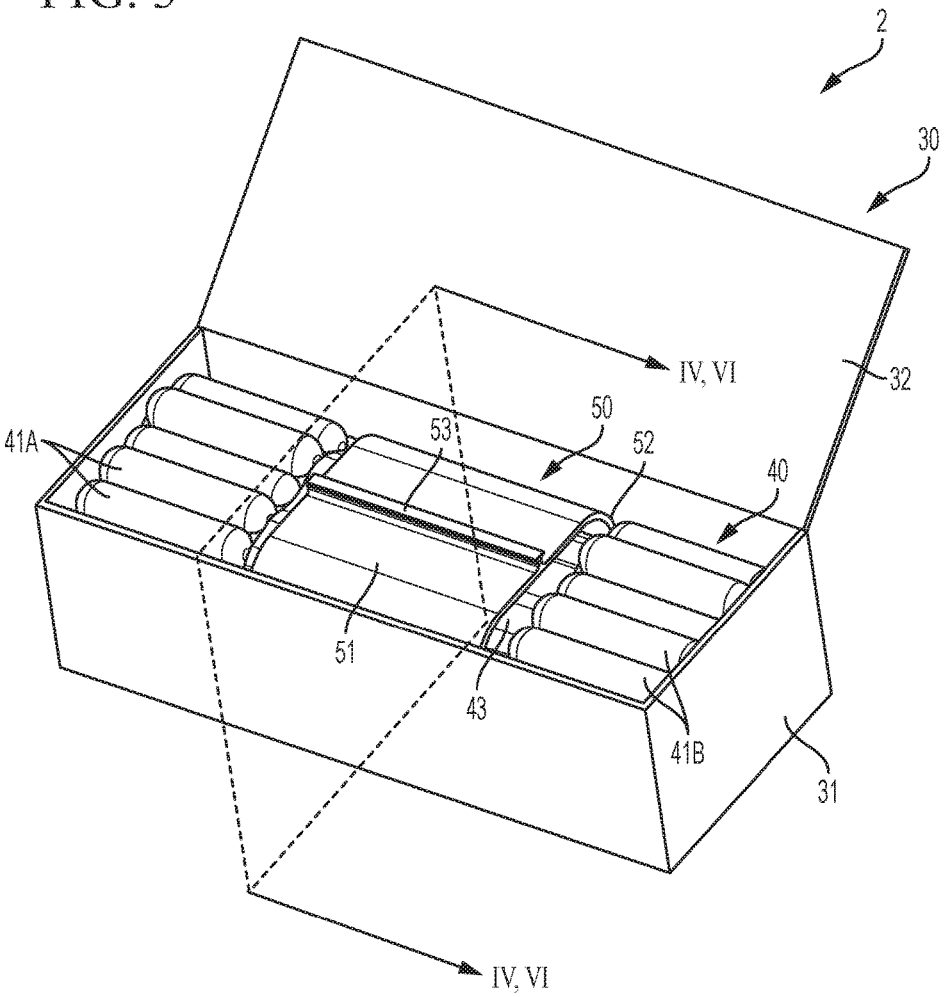
FIG. 3 is a perspective view illustrating a state in which an elastic member is attached to the cushion.

As illustrated in FIG. 2, the cushion 40 containing the process cartridge P is then placed into the container 31 of the container box 30. As illustrated in FIG. 3, the elastic member 50 is then attached to the central portion of the cylindrical portion 46 of the cushion 40 in the lengthwise direction, specifically, to the pressed portions 44. As a result, the pressed portions 44 are pressed by the respective nipping portions 52 of the elastic member 50. Thus, air stored in the pressed portions 44 is transferred to the air bags 41A, 41B through the connectors 45, thereby establishing the state in which the surfaces of the respective air bags 41A, 41B are stretched. That is, the amount of air contained in the pair of pressed portions 44 nipped between the pair of nipping portions 52 is less than the amount of air contained in the pair of pressed portions 44 not nipped between the pair of nipping portions 52. Accordingly, in the state in which the pair of pressed portions 44 are nipped between the pair of nipping portions 52, the distance between each of the pair of pressed portions 44 and the inner wall of the container 31 is greater than the distance between each of the air bags 41A, 41B and the inner wall of the container 31.

As illustrated in FIG. 4A, the lid 32 of the container box 30 is then closed to pack the process cartridge P.

There will be next explained operations and effects of the cushion 40 and the elastic member 50. As illustrated in FIG. 4B, when a shock is applied to the air bags 41A, 41B from outside, for example, when the user drops the packing member 1 packing the process cartridge P, air in the air bags 41A, 41B is transferred to the pressed portions 44 through the connectors 45. The transferred air inflates each of the pressed portions 44 in a direction away from the process cartridge P such that the pressed portions 44 are deformed with the respective nipping portions 52 of the elastic member 50. The shock is absorbed by this deformation of the nipping portions 52 of the elastic member 50.

In this deformation, the sheet-like portion 43 containing no air is not deformed. That is, the force applied from the cushion 40 to the elastic member 50 acts only in a direction in which the pair of nipping portions 52 are widen and does not act in a direction in which the base 51 is moved away from the cushion 40. This construction can prevent the elastic member 50 from being detached from the cushion 40.

In the present embodiment as described above, the following effects can be achieved. The base 51 is disposed between the lid 32 and the sheet-like portion 43 containing no air in the present embodiment. Thus, when a shock is applied to the cushion 40, a reaction force against the cushion 40 due to the transfer of the air is not transmitted to the lid 32 via the base 51, thereby preventing erroneous opening of the lid 32.

The cushion 40 is pressed by the elastic member 50 to stretch the surface of the cushion 40, thereby keeping a shock absorbing function of the cushion 40. When a shock is applied to the cushion 40, air in the cushion 40 pushes a portion of the cushion 40 which is pressed by the elastic member 50, so that the elastic member 50 is deformed. This construction can absorb the shock without excessive tension being imposed on the surface of the cushion 40, making it possible to prevent damage to the cushion 40.

Each of the air bags 41A, 41B has the portion overlapping the development region DR of the developing roller P2 when viewed in the radial direction of the developing roller P2. This construction enables each of the air bags 41A, 41B to well protect a portion of the process cartridge P which corresponds to the development region DR of the developing roller P2.

Each of the air bags 41A, 41B has the portion overlapping the corresponding one of the opposite end portions P21 of the developing roller P2 when viewed in the radial direction of the developing roller P2. This construction enables each of the air bags 41A, 41B to well protect the corresponding one of the opposite end portions P21 of the developing roller P2.

Each of the air bags 41A, 41B has the portion overlapping the corresponding one of the opposite end portions PE of the process cartridge P when viewed in the radial direction of the developing roller P2. This construction enables each of the air bags 41A, 41B to well protect the corresponding one of the opposite end portions PE of the process cartridge P.

Each of the nipping portions 52 is spaced apart from the inner surface of the container 31 in the state illustrated in FIG. 4A. Thus, the deformation of the nipping portions 52 is not obstructed by the inner surface of the container 31. Accordingly, when a shock is applied to the cushion 40, the nipping portions 52 can be deformed well, making it possible to prevent damage to the cushion 40.

The elastic member 50 is attachable to and detachable from the cushion 40 in the particular direction. This construction allows the user to easily attach the elastic member 50 to the cushion 40 when packing the process cartridge P and to easily detach the elastic member 50 from the cushion 40 when taking the process cartridge P out of the packing member 1.

The user can pull the elastic member 50 while holding the protrusion 53 protruding from the base 51, making it easy for the user to remove the elastic member 50 from the cushion 40.

While the embodiment has been described above, it is to be understood that the disclosure is not limited to the details of the illustrated embodiment, but may be embodied with various changes and modifications, which may occur to those skilled in the art, without departing from the spirit and scope of the disclosure. It is noted that the same reference numerals as used in the above-described embodiment are used to designate the corresponding elements of the following modification, and an explanation of which is dispensed with.

Figure 6:
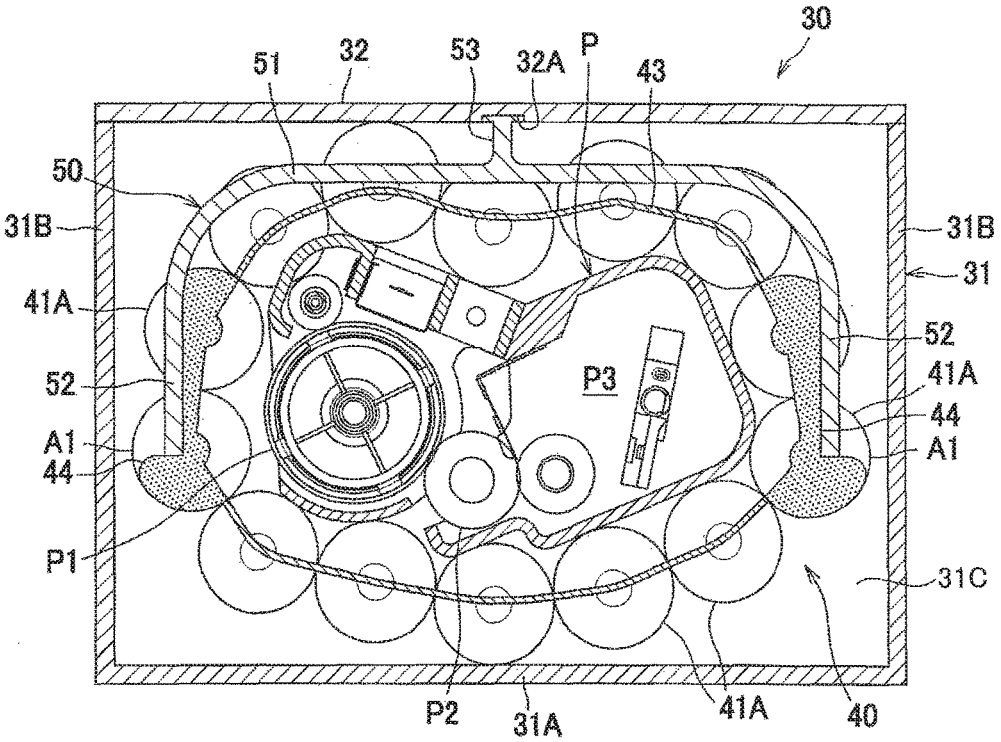
FIG. 6 is a cross-sectional view illustrating a modification.

As illustrated in FIG. 6, the lid 32 may have a recess 32A with which the distal end portion of the protrusion 53 is engageable. With this construction, the elastic member 50 is moved together with the lid 32, allowing the user to remove the elastic member 50 from the cushion 40 only by opening the lid 32. In this movement, the pressing force applied from the elastic member 50 to the cushion 40 is released, so that the cushion 40 is sagged in some degree, allowing the user to easily take the cushion 40 out of the container 31. That is, the user needs to only open the lid 32 to sag the cushion 40 and easily take the cushion 40 out of the container 31.

The elastic member 50 is formed of resin in the above-described embodiment, but the present disclosure is not limited to this construction. For example, the nipping portions 52 of the elastic member 50 may be formed of rubber. This construction allows the nipping portions 52 to be deformed more easily than in the case where the nipping portions 52 are formed of resin, whereby the elastic member 50 can be attached to and detached from the cushion 40 more easily. It is noted that the elastic member 50 may be any appropriate material such as metal.

In the above-described embodiment, the process cartridge P including not only the developing roller P2 but also the photoconductive drum P1 is taken as one example of the developing cartridge, but the present disclosure is not limited to this configuration. For example, the developing cartridge may not include the photoconductive drum. Also, the object is not limited to the developing cartridge and may be any object.

The gas is not limited to air, and other kinds of gas such as nitrogen may be employed.

What is claimed is:

1. A packing member, comprising:

a cushion comprising a first portion containing a gas, a no-gas containing portion not containing the gas and a pair of second portions communicable with the first portion and containing the gas;

an elastic member attachable to and detachable from the cushion and comprising a base and a pair of nipping portions respectively extending from opposite ends of the base; and a container box configured to contain the cushion and comprising a container formed with an opening and a lid that opens and closes the opening, wherein, when the cushion is contained in the container box and the opening is closed by the lid, the base is disposed between the lid and the no-gas containing portion; and each of the pair of nipping portions is disposed between the container and a corresponding one of the pair of second portions.

2. The packing member according to claim 1, wherein each of the pair of second portions is located between a pair of first portions in a first direction, and each of the pair of second portions and the no-gas containing portion are arranged in a second direction perpendicular to the first direction.

3. The packing member according to claim 2, wherein the no-gas containing portion is located between the pair of first portions in the first direction.

4. The packing member according to claim 1, wherein the no-gas containing portion is a sheet portion, and the no-gas containing portion has a cylindrical shape.

5. The packing member according to claim 4, wherein the first portion is disposed on the no-gas containing portion.

6. The packing member according to claim 1, wherein the pair of nipping portions extend in a direction from the respective opposite ends of the base, and wherein the base comprises a protrusion protruding in a second direction opposite to the direction in which the pair of nipping portions extend.

7. The packing member according to claim 6, wherein the lid is formed with a recess with which the protrusion is engageable.

8. The packing member according to claim 1, wherein the pair of nipping portions are formed of rubber.

9. The packing member according to claim 1, wherein the cushion comprises a restrainer that restrains movement of the elastic member along a surface of the cushion.

10. The packing member according to claim 9, further comprising a connector connecting the first portion and at least one of the pair of second portions to each other, wherein the connector is disposed at a position farther from an inner surface of the container than the first portion, and wherein a step formed between the first portion and the connector serves as the restrainer.

11. The packing member according to claim 1, wherein the gas is air.

* * * * *